US009765517B2

(12) United States Patent
Gramola

(10) Patent No.: US 9,765,517 B2
(45) Date of Patent: Sep. 19, 2017

(54) VIBRATION DAMPER DEVICE FOR PREFABRICATED WAREHOUSES AND SIMILAR BUILDINGS

(71) Applicant: POSEIDON GT S.r.l., Thiene (IT)

(72) Inventor: Gianfranco Gramola, Cassola (IT)

(73) Assignee: POSEIDON GT S.R.L., Thiene (IT)

( * ) Notice: Subject to any disclaimer, the term of this patent is extended or adjusted under 35 U.S.C. 154(b) by 0 days.

(21) Appl. No.: 14/777,725

(22) PCT Filed: Mar. 21, 2014

(86) PCT No.: PCT/IB2014/060041
§ 371 (c)(1),
(2) Date: Sep. 16, 2015

(87) PCT Pub. No.: WO2014/147598
PCT Pub. Date: Sep. 25, 2014

(65) Prior Publication Data

US 2016/0289959 A1 Oct. 6, 2016

(30) Foreign Application Priority Data

Mar. 21, 2013 (IT) ..... TV2013A0038

(51) Int. Cl.
*E04B 1/98* (2006.01)
*E04H 9/02* (2006.01)
(Continued)

(52) U.S. Cl.
CPC ..... *E04B 1/985* (2013.01); *E02D 27/34* (2013.01); *E04B 5/046* (2013.01); *E04H 5/02* (2013.01);
(Continued)

(58) Field of Classification Search
CPC . E04B 1/985; E04B 5/046; E04B 1/21; E04B 1/98; E02D 27/34; E02D 31/08;
(Continued)

(56) References Cited

U.S. PATENT DOCUMENTS 4,133,157 A * 1/1979 Bschorr ..... F16F 7/08 188/381
4,356,992 A * 11/1982 Benkert ..... E04H 9/021 248/573
(Continued)

FOREIGN PATENT DOCUMENTS

GB 2229918 10/1990
JP 2000265707 9/2000
JP WO 2011158823 A1 * 12/2011 ..... F16F 7/08

OTHER PUBLICATIONS

International Search Report and Written Opinion from International Search Report and Written Opinion from International Application No. PCT/IB2014/060041 mailed Nov. 13, 2014.

*Primary Examiner* — Brian Glessner
*Assistant Examiner* — Adam Barlow
(74) *Attorney, Agent, or Firm* — Dorsey & Whitney LLP

(57) ABSTRACT

A vibration damper device comprising: a rigid bracket having a substantially flat side shoulder including a substantially rectilinear longitudinal groove or slit thereon, and which is anchorable in a rigid manner on the body of the lintel or of the pillar, next to the covering beam or the plug panel, to arrange said side shoulder facing the lateral side of the covering beam or the surface of the plug panel, with the longitudinal groove or slit locally substantially parallel to the longitudinal axis of the covering beam or to the longitudinal axis of the plug panel; a movable slider slidably engages the longitudinal groove or slit, and is anchorable in a rigid manner to the body of the covering beam or to the body of the plug panel; and a deformable connecting mem-
(Continued)

ber with elastoplastic behavior, which is connectable to the movable slider in a rigid manner to the bracket.

13 Claims, 3 Drawing Sheets

(51) Int. Cl.
*E04B 5/04* (2006.01)
*E02D 27/34* (2006.01)
*E04H 5/02* (2006.01)
*E04B 1/21* (2006.01)

(52) U.S. Cl.
CPC ..... *E04H 9/021* (2013.01); *E04H 9/022* (2013.01); *E04H 9/024* (2013.01); *E04H 9/025* (2013.01); *E04B 1/21* (2013.01)

(58) Field of Classification Search
CPC ..... E04H 9/024; E04H 9/025; E04H 9/022; E04H 9/021; E04H 9/02; F16F 15/04; F16F 9/00; F16M 7/00; H02K 5/24
USPC ..... 52/167.1, 167.4, 167.7, 167.8; 248/562, 248/566, 591, 619, 636, 638
See application file for complete search history.

(56) References Cited

U.S. PATENT DOCUMENTS

| | | | | | |
|---|---|---|---|---|---|
| 4,987,708 | A | | 1/1991 | Wilcox | |
| 5,083,404 | A | | 1/1992 | Schulte | |
| 5,364,214 | A | * | 11/1994 | Fazekas | E04H 9/02 411/354 |
| 5,461,838 | A | * | 10/1995 | Heller | E04B 1/948 52/167.1 |
| 5,491,937 | A | * | 2/1996 | Watson | E04H 9/021 248/581 |
| 6,115,973 | A | * | 9/2000 | Goto | E04H 9/02 52/167.4 |
| 6,164,023 | A | * | 12/2000 | Horikiri | E04H 9/021 248/562 |
| 8,807,307 | B2 | * | 8/2014 | Choi | E04H 9/02 188/105 |
| 9,051,733 | B2 | * | 6/2015 | Yamao | F16F 7/08 |
| 2013/0118098 | A1 | * | 5/2013 | Constantinou | E04H 9/02 52/167.1 |
| 2013/0174501 | A1 | * | 7/2013 | Michael | F16F 9/303 52/167.1 |
| 2014/0000185 | A1 | * | 1/2014 | Wang | E04H 9/027 52/167.8 |

* cited by examiner

VIBRATION DAMPER DEVICE FOR PREFABRICATED WAREHOUSES AND SIMILAR BUILDINGS

TECHNICAL FIELD

The present invention relates to a vibration damper device for prefabricated warehouses and similar buildings.

More in detail, the present invention relates to a vibration damper for prefabricated reinforced-concrete warehouses, to which the following disclosure will make explicit reference without however losing in generality.

BACKGROUND ART

As is known, warehouses are particularly large and spacious prefabricated buildings that are usually designed to accommodate machinery for industrial or craft processing, or are used to temporarily store materials, goods or vehicles of various type, and which substantially consist of a large flat roof which rests in horizontal position on a series of vertical pillars usually made of reinforced-concrete.

In case of prefabricated reinforced-concrete warehouses, the horizontal roof is formed by a series of long horizontal reinforced-concrete lintels usually with L-shaped or overturned T-shaped transversal section, which are arranged parallel and next to each other, in abutment on the upper ends of the pillars; and by a series of horizontal reinforced-concrete covering beams, which are positioned spaced one next to the other, astride of two immediately adjacent lintels, so as to rest on the lintels with the two ends thereof.

Due to this particular modular structure with lintels and covering beams simply resting one on the other, the horizontal roof may be assembled using prefabricated reinforced-concrete lintels and covering beams.

Although it allows the costs for building the warehouse to be greatly contained, the modular structure described above does not provide great resistance to seismic events of undulatory type. In coincidence with this type of seismic events, the covering beams of the roof indeed tend to be displaced forwards and backwards and/or to rotate horizontally on the lintels, until one of the ends of one of the beams crosses/passes over the edge of the lintel and falls on the ground, with all the risks this involves for the people who may be inside the warehouse.

To obviate this drawback, certain manufacturers of prefabricated reinforced-concrete warehouses have decided to anchor the ends of the covering beams in a rigid manner to the various lintels by means of metal material brackets which are structured so as to prevent any related movement between the two components.

Obviously, the rigid connection between covering beams and lintels has made the upper part of the warehouse much more rigid and heavier, thus significantly modifying the dynamic behavior of the structure in response to seismic events, with the problems this involves. In case of seismic events, in fact, a more rigid and heavier roof may expose the reinforced-concrete pillars to much greater mechanical stresses than those projected, with the risks of building collapsing resulting therefrom.

DISCLOSURE OF INVENTION

Aim of the present invention is to counter the falling of the covering beams of the roof of a prefabricated reinforced-concrete warehouse in presence of seismic events of undulatory type, without however excessively stiffening the overall structure of the warehouse.

In compliance with the above aims, according to the present invention there is provided a vibration damper device for prefabricated warehouses and similar buildings as defined in claim 1, and preferably, though not necessarily, in any one of the claims dependent thereon.

According to the present invention there is also provided a building as defined in claim 11, and preferably, though not necessarily, in any one of the claims dependent thereon.

BRIEF DESCRIPTION OF THE DRAWINGS

The present invention will now be described with reference to the accompanying drawings, which illustrate a non-limiting embodiment thereof, in which.

BEST MODE FOR CARRYING OUT THE INVENTION

Figure 1:
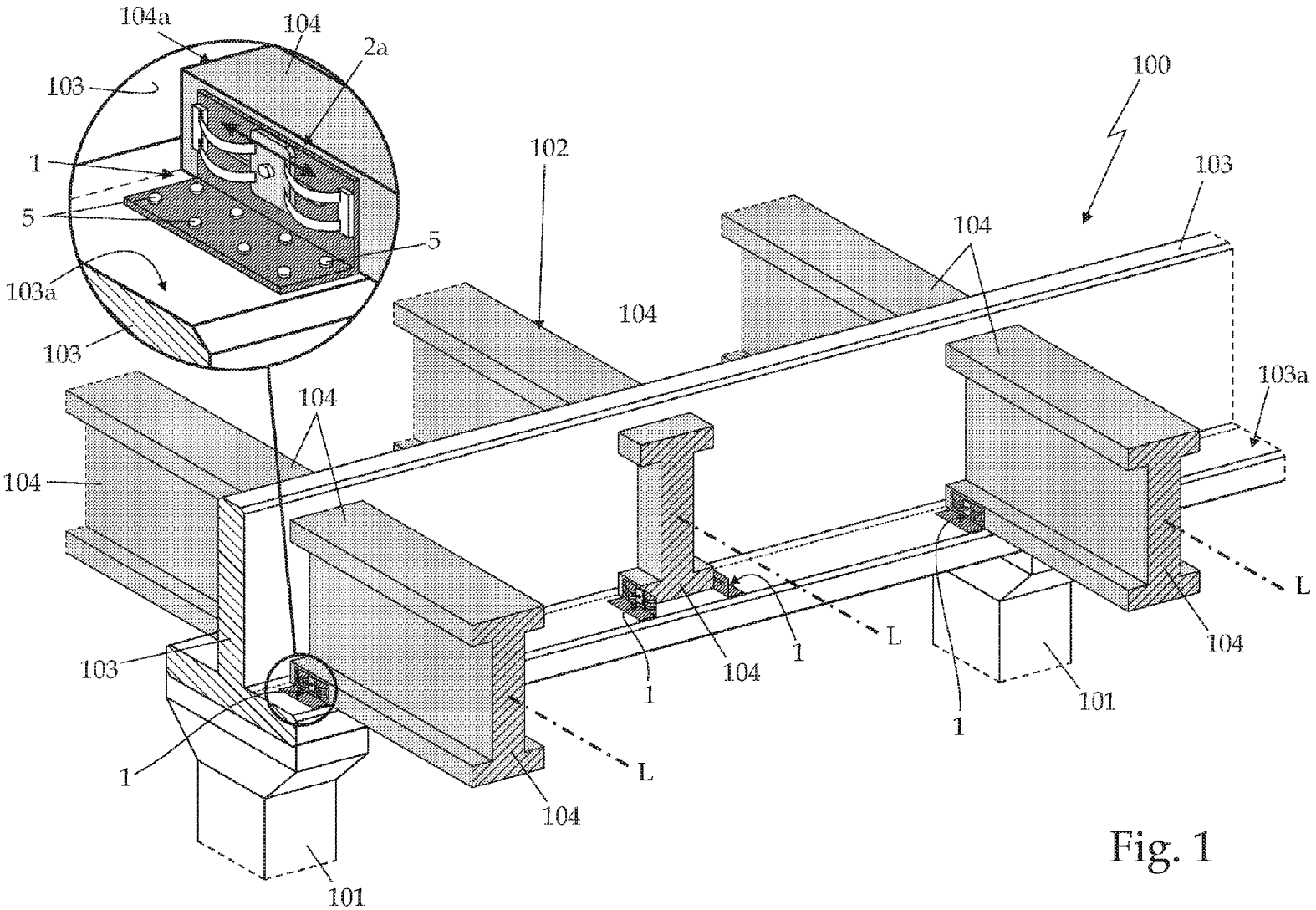
FIG. 1 shows a perspective view, with parts in section and parts removed for clarity, of a portion of the roof of a prefabricated reinforced-concrete warehouse provided with a series of vibration damper devices realized according to the teachings of the present invention.
Figure 2:
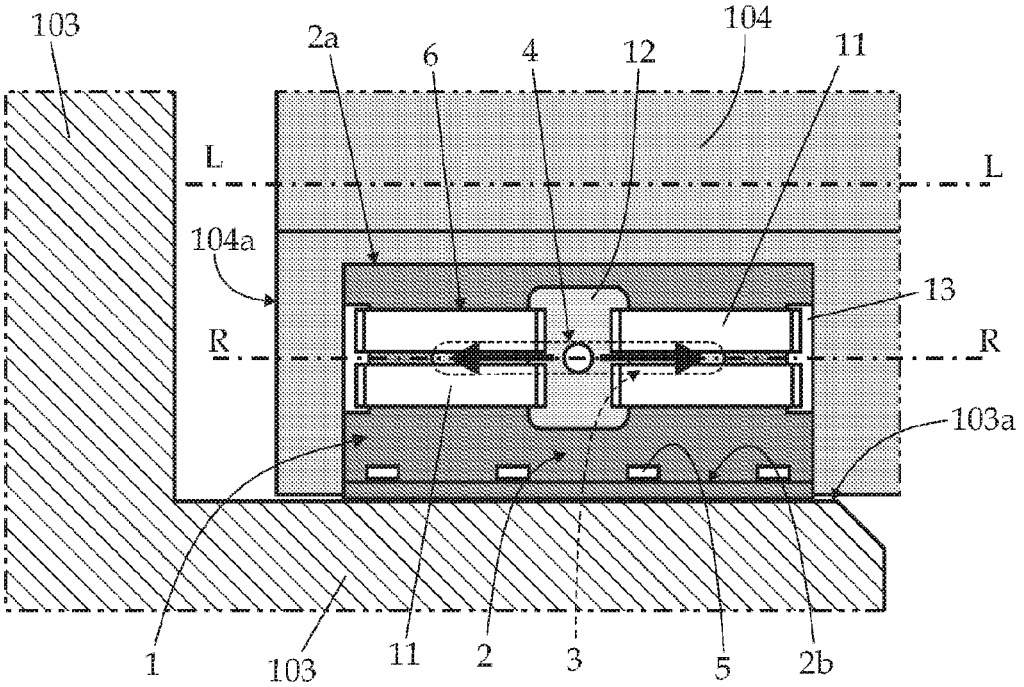
FIG. 2 shows, in enlarged scale and with parts in section and parts removed for clarity, a detail of the FIG. 1 warehouse.
Figure 3:
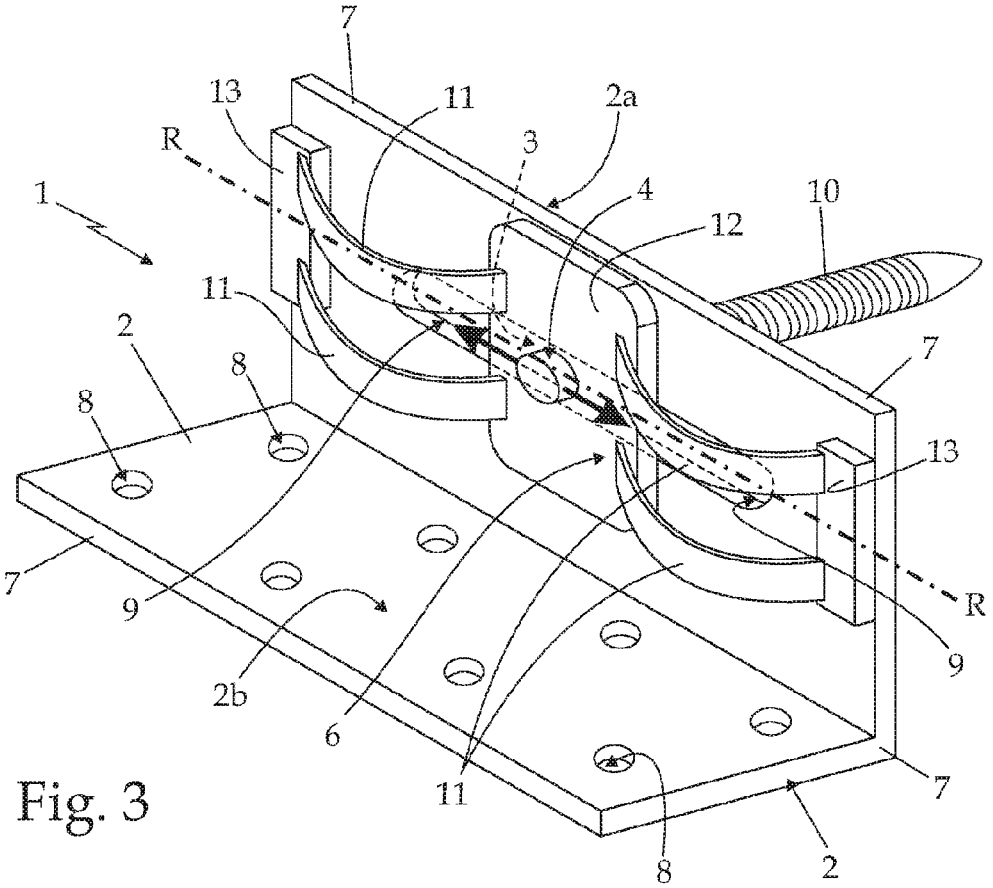
FIG. 3 shows a perspective view in enlarged scale, of a vibration damper device realized according to the teachings of the present invention.

With reference to FIGS. 1, 2 and 3, number 1 indicates as a whole a vibration damper device specifically structured to be installed at the axial ends of the covering beams of a prefabricated reinforced-concrete warehouse 100 or similar building structure.

More in detail, the prefabricated warehouse 100 is basically made up of series of load-bearing pillars 101 (two pillars shown in FIG. 1) which rise from the ground in substantially vertical direction, and are preferably, though not necessarily, made of reinforced-concrete; and a large, substantially flat, roof 102 which is arranged in substantially horizontal position at a predetermined height from the ground, in abutment on the top of the various pillars 101.

The horizontal roof 102, in turn, is made up of a series of long rectilinear lintels 103 which are arranged in substantially horizontal position, spaced one beside the other, so as to be in pairs locally substantially parallel and aligned with each other, and are placed in abutment on the upper ends of the load-bearing pillars 101, so as to extend astride of two or more adjacent load-bearing pillars 101 at a predetermined height from the ground; and of a series of rectilinear covering beams 104, which are arranged in substantially horizontal position, spaced one beside the other, so as to be locally substantially parallel and aligned with each other and substantially orthogonal to the lintels 103, and are placed straddling two immediately adjacent lintels 103, so as to arrange each of the two axial ends 104*a* of the beam in abutment on a respective lintel 103.

With reference to FIGS. 1 and 2, in the example shown, in particular, the lintels 103 preferably consists in prefabricated reinforced-concrete, rectilinear section bars, with preferably, though not necessarily, of L-shaped and/or of overturned T-shaped transversal section, which are provided with protruding lateral wings or ledges 103*a* which are structured so as to be able to support/carry the axial ends 104*a* of the covering beams 104.

Similarly, the covering beams 104 preferably consist in prefabricated reinforced-concrete rectilinear section bars, with preferably, though not necessarily, I-shaped or double T-shaped transversal section, which are structured so as to rest with the two axial ends 104*a* directly on the lateral wings or ledges 103*a* of the two separate lintels 103.

With reference to FIGS. 1, 2 and 3, the vibration damper device 1 instead comprises: a rigid bracket 2 preferably made of metal material, which is provided with a substantially flat side shoulder 2*a* on which a substantially rectilinear and preferably also pass-through longitudinal groove or slit 3 is realized, and which is structured so as to be anchored in rigid manner on the body of lintel 103, or better on the protruding wing 103*a* of lintel 103, so as to arrange said side shoulder 2*a* of the bracket directly facing and grazing the lateral side of the covering beam 104, with the reference axis R of the longitudinal groove or slit 3 locally substantially parallel to the longitudinal axis L of the covering beam 104; a movable slider 4 which slidably engages the longitudinal groove or slit 3 of bracket 2, and is structured so as to be anchored in rigid manner to the body of the covering beam 104.

More in detail, bracket 2 is substantially L-shaped, so as to be provided with an upper portion 2*a* and with a lower portion 2*b* substantially orthogonal one to the other. The lower portion 2*b* is structured to be arranged in abutment on lintel 103, or better on the protruding wing 103*a* of lintel 103, and to be anchored in rigid manner on the body of lintel 103 preferably by means of an appropriate number of pass-through anchoring screws 5 or other type of reinforced-concrete foundation bolts. The upper portion 2*a* is instead structured to be arranged facing and grazing the lateral side of the covering beam 104, and is provided with a substantially rectilinear and preferably pass-through longitudinal groove or slit 3, which extends in the body of bracket 2 parallel to a reference axis R locally substantially parallel to the laying plane of the supporting surface of the lower portion 2*b*.

The upper portion 2*a* of the L-shaped bracket 2 thus forms the side shoulder 2*a* of the bracket.

Bracket 2 is adapted to be anchored in a rigid manner on the lateral wing 103*a* of lintel 103, next to the axial end 104*a* of the covering beam 104, with the lower portion 2*b* in abutment on the body of lintel 103, close to the lateral side of the covering beam 104; and with the upper portion 2*a* grazing the lateral side of the covering beam 104, so that the longitudinal groove or slit 3 is arranged horizontally, substantially parallel to the longitudinal axis L of the covering beam 104.

The movable slider 4 is instead adapted to be anchored in a rigid manner directly on the lateral side of the covering beam 104, so as to form a single body with the covering beam 104.

Additionally, the vibration damper device 1 also comprises a deformable connecting member 6 with elastoplastic behavior, which is structured so as to connect the movable slider 4 in rigid manner to bracket 2, and to deform in elastoplastic manner as a result of any displacement of the movable slider 4 along the longitudinal groove or slit 3 of bracket 2.

Obviously, the elastoplastic deformation of the deformable connecting member 6 dissipates the kinetic energy of the covering beam 104 that moves on lintel 103 parallel to the longitudinal groove or slit 3 of bracket 2.

With reference to FIGS. 1, 2 and 3, in the example shown, in particular, bracket 2 is preferably formed by a substantially rectangular metal plate 7 of appropriate thickness, which is L bent so as to have two flat portions locally substantially orthogonal one to the other.

A first flat portion of the metal plate 7 is specifically structured to be arranged in abutment on the body of lintel 103, or better on the protruding wing 103*a* of lintel 103, and is preferably provided with a series of pass-through holes 8 which are dimensioned to be engaged in pass-through manner by the pass-through anchoring screws 5. The second flat portion of the metal plate 7 is provided with a long rectilinear pass-through slotted hole 9, which extends in the body of the metal plate 2 while remaining locally parallel to the laying plane of the first flat portion of the metal plate 2.

The first flat portion of the metal plate 7 forms the lower portion 2*b* of bracket 2; while the second flat portion of the metal plate 7 forms the side shoulder 2*a* of bracket 2, and the rectilinear pass-through slotted hole 9 is the longitudinal groove or slit 3 of the side shoulder 2*a*.

The movable slider 4 is instead preferably consists in the head of an anchor pin 10 which is adapted to be planted and/or fixed in a rigid manner in the lateral side of the covering beam 104, so as to be rigidly integral with the body of the covering beam 104.

With particular reference to FIG. 3, the deformable connecting member 6 with elastoplastic behavior instead comprises at least one metal material, U-shaped connecting member 11 which has a first end integral with the body of the movable slider 4 and a second end integral with the body of bracket 2, so as to be able to deform in elastoplastic manner as a result of any displacement of the movable slider 4 along the longitudinal groove or slit 3 of bracket 2.

In the example shown, in particular, the deformable connecting member 6 with elastoplastic behavior is preferably provided with at least two metal material, U-shaped connecting members 11, which are arranged on opposite sides of the movable slider 4, preferably aligned one after the other along the reference axis R of the longitudinal groove or slit 3, and both have a first end connected in rigid manner to the body of the movable slider 4 and a second end connected in rigid manner to the body of bracket 2, so as to be able to stretch or warp, respectively and alternatively, in elastoplastic manner as a result of any displacement of the movable slider 4 along the longitudinal groove or slit 3 of bracket 2.

Preferably, each U-shaped connecting member 11 also consists in a substantially C- or U-shape bent metal bar 11 which has a first end connected in a rigid manner to the body of the movable slider 4 and a second end connected in a rigid manner to the body of bracket 2, so as to be able to stretch or warp in elastoplastic manner as a result of any displacement of the movable slider 4 along the longitudinal groove or slit 3 of bracket 2.

With reference to FIGS. 2 and 3, in the example shown, in particular, the deformable connecting member 6 preferably comprises: a central bushing 12 which is structured so as to be fitted directly on the movable slider 4, i.e. on the head of anchor pin 10; two lateral anchoring plates 13 which are fixed in a rigid manner on the upper flat portion 2*a* of the metal plate 2, on opposite sides of the rectilinear pass-through slotted hole 9 along the reference axis R of the slotted hole, and preferably against the two ends of the rectilinear pass-through slotted hole 9; and at least two U-shaped metal connecting members 11 which are arranged on opposite sides of the central bushing 12, and are structured so as to connect, in a rigid manner, the body of the central bushing 12 each with a respective lateral anchoring plate 13.

More in detail, in the example shown, the deformable connecting member 6 comprises two pairs of U-shaped metal connecting members 11, which are arranged on opposite sides of the central bushing 12, and each pair of members is structured so as to connect, in a rigid manner, the body of the central bushing 12 with a respective lateral anchoring plate 13.

In other words, both U-shaped members 11 of each pair of U-shaped members have a first end integral to the body of the central bushing 12 and a second end integral to the immediately facing lateral anchoring plate 13, so that the two U-shaped members 11 of each pair of U-shaped connecting members 11 is able to stretch or warp as a result of any displacement of the movable slider 4 along the longitudinal groove or slit 3 of bracket 2.

Preferably, though not necessarily, the U-shaped members 11 may also have different shapes and/or sections, or be realized with different metal materials, so as to be able to regulate the capacity to dissipate the energy of the vibration damper device 1.

The installation of the vibration damper devices 1 in the prefabricated warehouse 100 provides positioning two vibration damper devices 1 on opposite sides of each of the two axial ends 104*a* of all, or only a part, of the covering beams 104 which form the horizontal roof 102 of the prefabricated warehouse 100, so as to keep the covering beams 104 always substantially orthogonal to the related lintels 103, while allowing in any case each covering beam 104 to be displaced freely forwards and backwards, parallel to its own longitudinal axis L.

In presence of a seismic event of undulatory type, each vibration damper device 1 allows the covering beam 104 to which it is coupled to be displaced forwards and backwards, parallel to its longitudinal axis L. The displacements of the covering beam 104 require however a much greater quantity of energy with respect to the one required in the absence of the vibration damper device 1.

As a result, roof 102 of the prefabricated warehouse 100 is capable of absorbing/dissipating a very large quantity of seismic energy, while however maintaining a dynamic behavior rather similar to the one of the roof of a traditional prefabricated warehouse.

Computer simulations in fact have emphasized that the installation of the vibration damper devices 1 on the roof of a generic prefabricated reinforced-concrete warehouse allows to significantly reduce the risks of the roof collapsing, without however putting at risk the structural integrity of the pillars that support the roof.

The capacity to resist seismic stresses of a prefabricated reinforced-concrete warehouse 100 equipped with an appropriate number of vibration damper devices 1 is therefore significantly higher than that of a traditional prefabricated reinforced-concrete warehouse.

The advantages associated to the use of the vibration damper device 1 are considerable.

The installation of an appropriate number of vibration damper devices 1 on the roof of a generic prefabricated reinforced-concrete warehouse allows to significantly reduce the risks of the roof collapsing, while at the same time increasing the capacity of the building to resist a seismic event of undulatory type.

Additionally, the vibration damper device 1 has particularly low production costs, thus allowing the seismic resistance of a prefabricated reinforced-concrete warehouse to be increased at contained costs.

Figure 4:
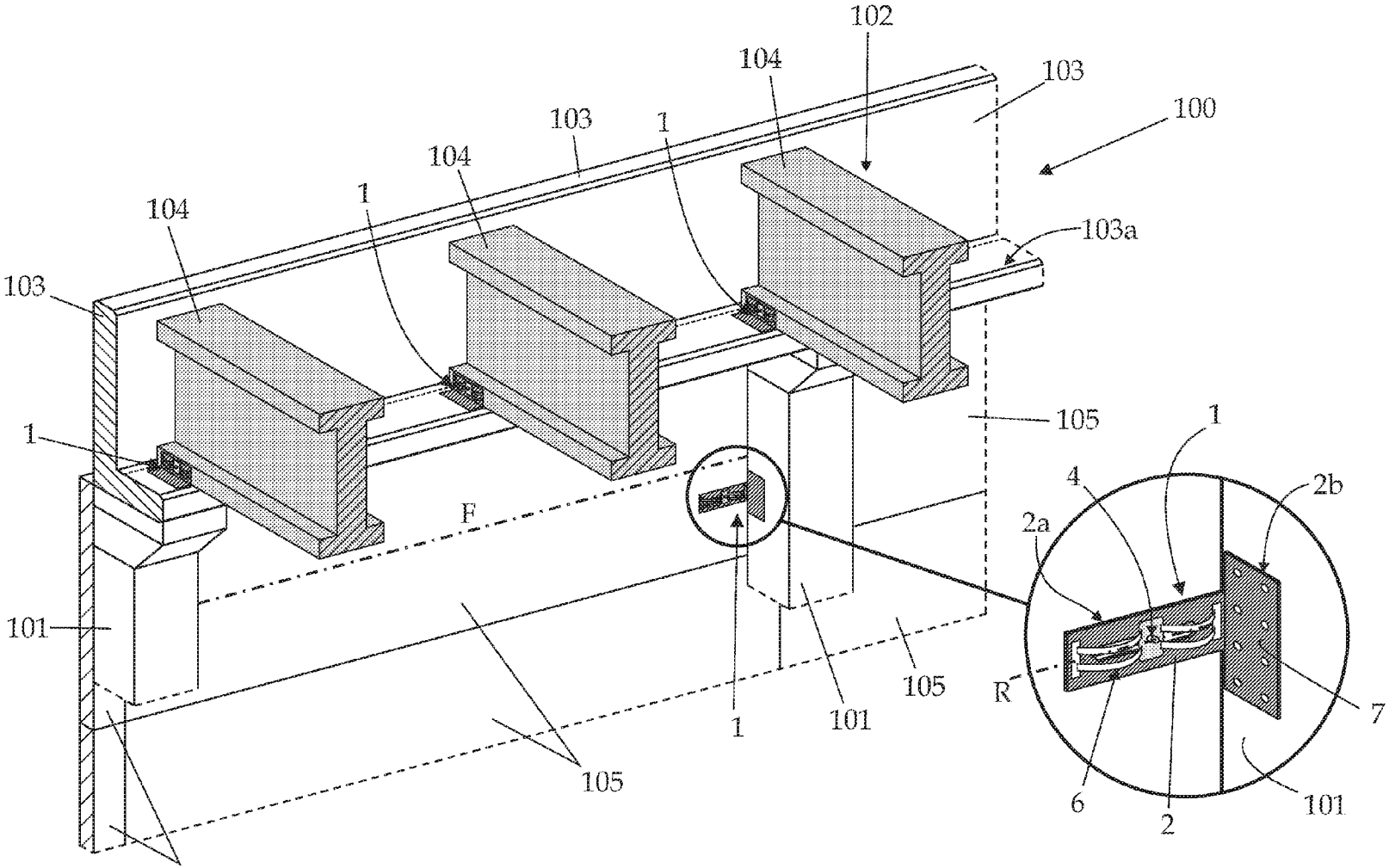
FIG. 4 instead shows a perspective view, with parts in section and parts removed for clarity, of a portion of the face of a prefabricated reinforced-concrete warehouse provided with a different embodiment of the vibration damper devices shown in FIG. 1.

Clearly, changes and variants may be made to the vibration damper device 1 without however departing from the scope of the present invention For example, with reference to FIG. 4, prefabricated warehouse 100 may also comprise a series of plug panels 105 which are arranged in vertical position, one next to the other and in abutment on the lateral side of the vertical pillars 101, so as to form the perimeter wall or walls of the prefabricated warehouse 100; and the vibration damper device 1 may be structured to connect the plug panels 105 to the related pillars 101, so as to also reduce the amplitude of the horizontal displacements of the plug panels 105 in the presence of seismic events of undulatory type.

More in detail, the rigid bracket 2 may be structured so as to be anchored in a rigid manner on the body of pillar 101, so as to arrange the side shoulder 2*a* of the bracket directly facing and grazing the surface of the plug panel 105, with the reference axis R of the longitudinal groove or slit 3 arranged horizontally and locally substantially parallel to the horizontal longitudinal axis F of the plug panel 105.

The movable slider 4 is instead adapted to be anchored in a rigid manner directly on the face of the plug panel 105 which rests on and covers pillar 101, so as to form a single body with the plug panel 105.

More in detail, in this embodiment, the lower portion 2*b* of bracket 2 is structured to be arranged in abutment on the side of pillar 101, and to be anchored in a rigid manner on the body of pillar 101 preferably by means of an appropriate number of pass-through anchoring screws 5 or other type of reinforced-concrete foundation bolts.

The upper portion 2*a* of bracket 2, i.e. the side shoulder 2*a*, is instead structured to be arranged facing and grazing the surface of the plug panel 105, and is provided with a substantially rectilinear and preferably also pass-through longitudinal groove or slit 3, which extends in the body of bracket 2 parallel to a reference axis R locally substantially perpendicular to the laying plane of the supporting surface of the lower portion 2*b*.

In other words, in this embodiment bracket 2 preferably consists in a metal plate 7 of appropriate thickness, which is L bent so as to have two flat portions locally substantially orthogonal one to the other. A first flat portion of metal plate 7 is specifically structured to be arranged in abutment on the body of pillar 101, and is preferably provided with a series of pass-through holes (not shown) which are dimensioned to be engaged in a pass-through manner by just as many pass-through anchoring screws 5 or other type of concrete foundation bolts. The second flat portion of metal plate 7 is instead provided with a long rectilinear pass-through slotted hole 9, which extends in the body of the metal plate 2 thus remaining locally substantially perpendicular to the laying plane of the first flat portion of metal plate 7.

The invention claimed is:

1. A vibration damper device for a building structure including a series of substantially vertical load-bearing pillars and at least one plug panel arranged in a substantially vertical position in abutment on a lateral side of said substantially vertical load-bearing pillars, and/or at least one horizontal lintel in abutment on said substantially vertical load-bearing pillars and at least one horizontal covering beam that extends transversely to the lintel and has an axial end in abutment on the lintel; the vibration damper device comprising:

a rigid bracket including a substantially flat, side shoulder having a substantially rectilinear longitudinal groove or slit, and which is structured so as to be anchored in a rigid manner on a body of the at least one horizontal lintel or of the substantially vertical load-bearing pillar, next to the at least one horizontal covering beam or next to the at least one plug panel, so as to arrange the substantially flat, side shoulder facing the lateral side of the at least one horizontal covering beam or facing a surface of the at least one plug panel, with the longitudinal groove or slit locally substantially parallel to a longitudinal axis of the at least one horizontal covering beam or to a longitudinal axis of the at least one plug panel;

a movable slider that slidably engages the longitudinal groove or slit provided on the substantially flat, side shoulder, and is structured so as to be rigidly anchored to a body of the at least one horizontal covering beam or to a body of the at least one plug panel; and a deformable connecting member with elastoplastic behavior, which is structured so as to connect the movable slider in rigid manner to the rigid bracket, and to deform in elastoplastic manner as a result of any displacement of the movable slider along the longitudinal groove or slit of the rigid bracket.

2. The vibration damper device according to claim 1, wherein the rigid bracket is substantially L-shaped, so as to be provided with a lower portion and with an upper portion substantially orthogonal one to the other; the lower portion being structured to be arranged in abutment on and then anchored in rigid manner to the body of the lintel or to the body of the substantially vertical load-bearing pillar; the upper portion being instead structured to be arranged facing and grazing the lateral side of the at least one horizontal covering beam or the surface of the at least one plug panel; and being provided with the longitudinal groove or slit that extends in a body of the rigid bracket substantially parallel to a reference axis locally substantially parallel or substantially perpendicular to a laying plane of a supporting surface of the lower portion, so as to form the substantially flat, side shoulder of the rigid bracket.

3. The vibration damper device according to claim 2, wherein the rigid bracket is formed by a metal plate, which is L bent so as to have two flat portions locally substantially orthogonal to one another; a first flat portion of the metal plate being structured to be arranged in abutment on and then anchored in rigid manner to the body of the lintel or on/to the body of the substantially vertical load-bearing pillar; a second flat portion of the metal plate being instead provided with a rectilinear pass-through slotted hole that extends in a body of the metal plate while remaining locally substantially parallel or substantially orthogonal to the laying plane of the first flat portion of the metal plate.

4. The vibration damper device according to claim 2, wherein the lower portion of the rigid bracket is structured to be anchored in rigid manner on the body of the lintel or on the body of the substantially vertical load-bearing pillar by pass-through anchoring screws or reinforced-concrete foundation bolts.

5. The vibration damper device according to claim 1, wherein the movable slider includes a head of an anchor pin that is adapted to be planted and/or rigidly fixed in the lateral side of the at least one horizontal covering beam or on a face of the at least one plug panel, so as to be rigidly fixed to the body of the at least one horizontal covering beam or to the body of the at least one plug panel.

6. The vibration damper device according to claim 1, wherein the deformable connecting member includes at least one metal material, U-shaped connecting member that has a first end integral with the body of the movable slider and a second end integral with the body of the rigid bracket, so as to be able to deform in elastoplastic manner as a result of any displacement of the movable slider along the longitudinal slit or groove of the rigid bracket.

7. The vibration damper device according to claim 6, wherein the deformable connecting member includes at least two U-shaped connecting members arranged on opposite sides of the movable slider, and each of the at least two U-shaped connecting members has a first end integral with the body of the movable slider and a second end integral with the body of the rigid bracket, so as to be able to deform in elastoplastic manner as a result of any displacement of the movable slider along the slit or longitudinal groove of the rigid bracket.

8. The vibration damper device according to claim 7, wherein the deformable connecting member includes at least two U-shaped connecting members that are arranged on opposite sides of the movable slider aligned one after the other along a reference axis of the longitudinal groove or slit, so as to be able, respectively and alternatively, to stretch or warp in elastoplastic manner as a result of any displacement of the movable slider along the longitudinal groove or slit of the rigid bracket.

9. The vibration damper device according to claim 3, wherein the deformable connecting member includes:

a central bushing structured so as to be fitted directly on the movable slider;

two lateral anchoring plates that are fixed in rigid manner on the second flat portion of the metal plate, on opposite sides of the rectilinear through slotted hole along the reference axis of the rectilinear through slotted hole; and at least two metal material, U-shaped connecting members that are arranged on opposite sides of the central bushing, and are structured so as to rigidly connect the body of the central bushing each with a respective one of the two lateral anchoring plates.

10. The vibration damper device according to claim 7, wherein each of the at least two U-shaped connecting member is formed by a substantially C-shape or U-shape bent metal bar that has a first end rigidly connected to the body of the movable slider and a second end rigidly connected to the body of the rigid bracket.

11. A building of a type comprising the series of substantially vertical pillars, the at least one horizontal lintel arranged in abutment on the substantially vertical pillars, and the at least one horizontal covering beam that extends transversely to the lintel and has the axial end in abutment on the lintel; the axial end of the at least one horizontal covering beam is connected to the lintel by at least one of the vibration damper devices, the at least one of the vibration damper devices including:

a rigid bracket including a substantially flat, side shoulder having a substantially rectilinear longitudinal groove or slit, and which is structured so as to be anchored in a rigid manner on a body of the at least one horizontal lintel or of the substantially vertical load-bearing pillar, next to the at least one horizontal covering beam or next to the at least one plug panel, so as to arrange the substantially flat, side shoulder facing the lateral side of the at least one horizontal covering beam or facing a surface of the at least one plug panel, with the longitudinal groove or slit locally substantially parallel to a longitudinal axis of the at least one horizontal covering beam or to a longitudinal axis of the at least one plug panel;

a movable slider that slidably engages the longitudinal groove or slit provided on the substantially flat, side shoulder, and is structured so as to be rigidly anchored to a body of the at least one horizontal covering beam or to a body of the at least one plug panel; and a deformable connecting member with elastoplastic behavior, which is structured so as to connect the movable slider in rigid manner to the rigid bracket, and to deform in elastoplastic manner as a result of any displacement of the movable slider along the longitudinal groove or slit of the rigid bracket.

12. The building according to claim 11, wherein the axial end of the at least one horizontal covering beam is connected to the lintel by two of the vibration damper devices arranged on opposite sides of the axial end.

13. The building according to claim 11, further comprising at least one plug panel arranged in a substantially vertical position, in abutment on the lateral side of the substantially vertical pillars; and in that the at least one plug panel is connected to the substantially vertical pillars by at least one of the vibration damper devices.

* * * * *